United States Patent [19]

Lowery

[11] Patent Number: 4,917,015

[45] Date of Patent: Apr. 17, 1990

[54] FIREWORKS ROCKET LAUNCH PAD

[76] Inventor: Charles S. Lowery, 300 Elkmont Rd., Knoxville, Tenn. 37922

[21] Appl. No.: 164,972

[22] Filed: Mar. 7, 1988

[51] Int. Cl.[4] ..... F42B 4/26

[52] U.S. Cl. ..... 102/342; 102/344; 102/357; 102/361

[58] Field of Search ..... 102/342, 343, 344, 357, 102/360, 361; 248/420

[56] References Cited

U.S. PATENT DOCUMENTS

| | | | |
|---|---|---|---|
| 29,118 | 7/1860 | Woodward | 102/360 X |
| 1,003,082 | 9/1911 | Ziegenfuss | 102/343 X |
| 1,776,354 | 9/1930 | Edmands | 102/343 X |
| 2,005,826 | 6/1935 | Kulp et al. | 248/44 |
| 2,306,442 | 12/1942 | Holmes | 102/360 |
| 2,795,386 | 6/1957 | Elsey | 248/46 |
| 2,923,240 | 2/1960 | Blewer | 248/46 |
| 4,148,258 | 4/1979 | Powers | 102/343 |
| 4,724,768 | 2/1988 | Robinson et al. | 102/349 |

*Primary Examiner*—Peter A. Nelson

*Attorney, Agent, or Firm*—Pitts and Brittian

[57] ABSTRACT

A fireworks rocket launch pad (10) for holding and aiming a rocket (12) as it is being launched. The rocket launch pad (10) comprises a rocket receiving member (30) which slidably receives and aims the rocket (12). The receiving member (30) is mounted on a base (16) which engages a supporting surface such as the ground, driveway or the like. The receiving member (30) and the base (16) can be adjusted for selecting the angle "A" at which the rocket is launched.

5 Claims, 2 Drawing Sheets

FIREWORKS ROCKET LAUNCH PAD

DESCRIPTION

1. Technical Field

This invention relates generally to fireworks, and more particularly concerns a fireworks launch pad which holds a bottle rocket or the like at a preselected angle as it is launched.

2. Background Art

Fireworks rockets are positioned at a selected location prior to launching. Conventionally, such rockets are placed in bottles, or other containers, which receive the stem or elongated portion of the rocket while leaving the fuse exposed for contact with a flame. Such jerry-built devices for launching rockets suffer disadvantages. For example, the rocket holder can tip over during the ignition process or as the person applying the flame to the rocket fuse hurries away from the launch site. Moreover, it is difficult to adjust the angle at which the rocket is launched.

Accordingly, it is an object of the present invention to provide a fireworks rocket launch pad which provides support of a rocket during takeoff.

Another object of the present invention is to provide such a rocket launch pad which can be inexpensively manufactured and readily assembled.

Yet another object of the present invention is to provide a rocket launch pad which permits ready adjustment of the launch angle.

DISCLOSURE OF THE INVENTION

Other objects and advantages will be accomplished by the present invention which provides a rocket launcher or a fireworks rocket launch pad for holding a fireworks rocket at a selected angle during launching. The launch pad comprises a member which slidably receives and aims the rocket. This member is mounted on a base which firmly supports the pad on a supporting surface such as the ground. The member which receives the rocket can be adjusted with respect to the base for selecting the angle at which the rocket is aimed and launched.

BRIEF DESCRIPTION OF THE DRAWINGS

The above-mentioned features of the invention will become more clearly understood from the following detailed description of the invention read together with the drawings in which:

FIGS. 3 through 6 illustrate alternate embodiments of a fireworks rocket launch pads, and more specifically, disclose alternate embodiments for securing the member for slidably receiving and aiming the rocket to the base such that the angle at which the rocket is launched can be adjusted.

BEST MODE FOR CARRYING OUT THE INVENTION

A fireworks rocket launch pad incorporating various features of the present invention is illustrated generally at 10 in the figures. It will become apparent from the discussion which follows that the launch pad 10 of the present invention is designed for receiving and aiming a bottle rocket 12, or the like, such that the rocket fuse 14 is exposed and can be readily contacted by a flame. Whereas the invention is generally discussed in terms of holding a bottle rocket 12, it will be appreciated that it can be utilized for holding other forms of elongated fireworks such as Roman candles.

Figure 1:
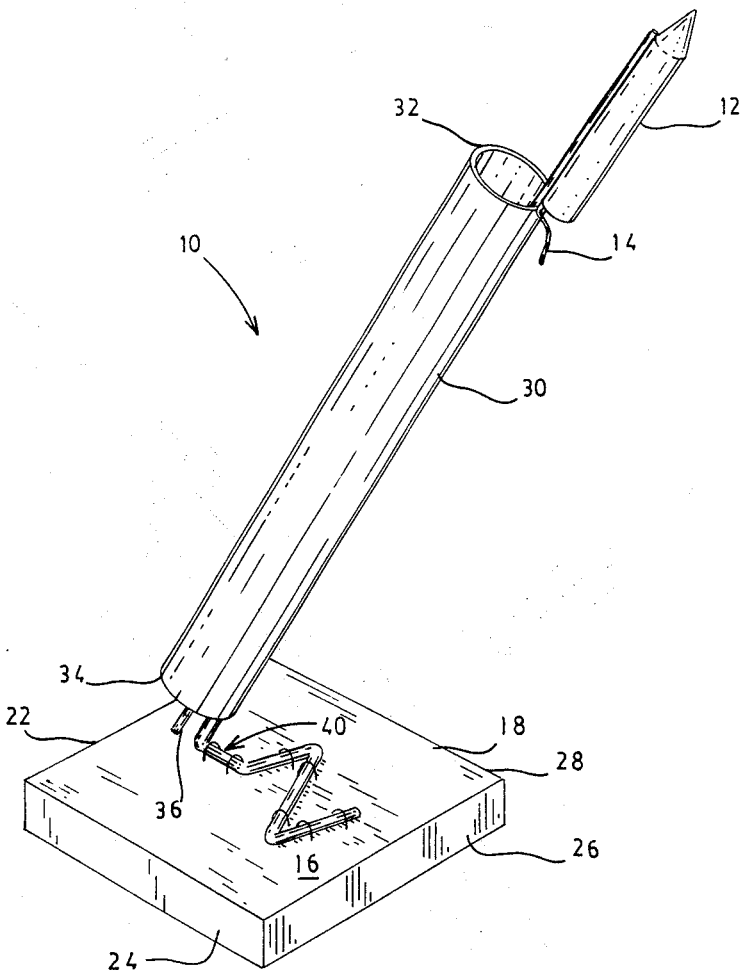
FIG. 1 illustrates a rocket launch pad for a bottle rocket or the like constructed in accordance with various features of the present invention.

Referring now to FIG. 1, the launch pad 10 comprises a base 16 which is designed for engaging a suitable supporting surface such as the ground, driveway or the like, and which holds the launch pad 10 in position as a rocket is launched. In the embodiment depicted in FIG. 1, the base is generally rectangular in cross-sectional outline and fabricated from a suitable rigid or semi-rigid material such as wood, plastic or the like. The base 16 defines an upper surface 18, a lower surface 20 and four upstanding edges or walls 22, 24, 26, and 28, which connect the perimeters of the upper surface 18 with the lower surface 20. It should be noted that while the base 16 has a generally square or rectangular configuration as shown in the figures, it could be circular, triangular or assume other selected geometries, its principal purpose being to support the launch pad on a suitable supporting surface.

A member generally indicated at 30 is mounted on the base 16 and serves to slidably receive and aim the rocket 12. In the illustrated embodiment, this member comprises an elongated tube of cylindrical shape having an open upper end portion 32 and an open lower end portion 34. This member 30 has an internal diameter sufficient for readily receiving the rocket 12, or more specifically, in the preferred embodiment the stem portion of the rocket 12. The longitudinal axis of the rocket 12 is substantially parallel with, or coextensive with, the longitudinal axis of the member 30 such that the rocket 12 is aimed in a direction determined by the orientation of the member 30 with respect to the base 16.

As shown in FIG. 1, the lower end portion of rocket 12 indicated at 36 extends through the lower end portion 34 of the member 30, and rests against the upper surface 18 of pad 16. It will be recognized, however, that if necessary or desired, the lower end portion 34 of the member 30 could be closed such that the end portion 36 of the rocket 12 is contained within the member 30. For example, as is shown in FIG. 5, a suitable cap 38 can be provided for covering the lower end portion 34 of the member 30.

Means generally indicated at 40 serve to mount the rocket receiving member 30 on the base 16. In the illustrated embodiment, the means 40 comprises a wire having one end portion secured to the base 16 and another end portion secured to the member 30 such that this member 30 is held at a selected angle of orientation "A" (See FIG. 2) with respect to the base 16.

Figure 2:
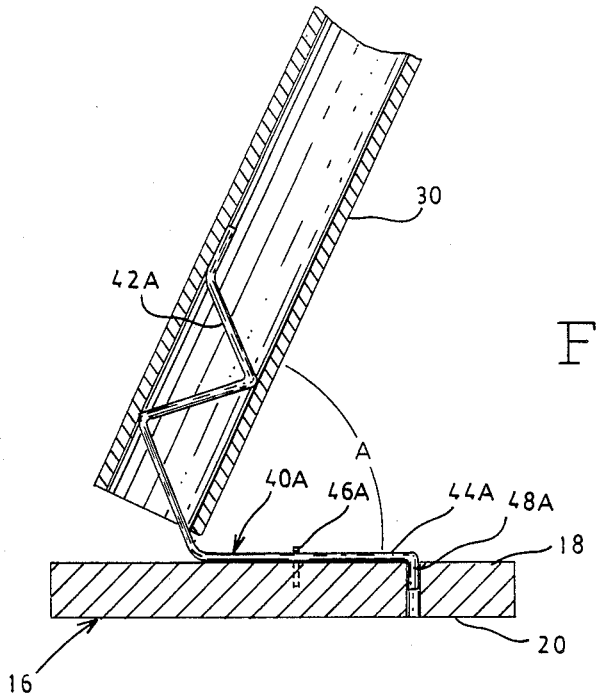
FIG. 2 illustrates a cross-sectional view of a launch pad of the type illustrated at FIG. 1.

FIGS. 2 through 6 disclose various embodiments of means for mounting the member 30 on the base 16. Moreover, it will be noted that adjustment of the orientation angle "A", as is shown in FIG. 2, of the member 30 with respect to the base 16 can be readily accomplished by simply bending the wire comprising means 40 by applying force to the rocket receiving member 30 and holding the base 16 firm, or vice versa. As this bending force is applied, the wire 40 bends, until the orientation angle "A" is fixed as desired. This angle is maintained when the pad is released due to the shape which is held by the wire.

Referring now to FIG. 2, alternate means 40A for mounting the member 30 on the base 16 includes end portion 42A which is helically-shaped and designed for being received within the internal diameter of the member 30 such that it engages the inner surface of the wall. The opposite end portion 44A of the means 40A is secured to the base 16 by a suitable staple 46A. It will also be noted that the terminus end portion 48A of the means 48 is inserted into a suitable bore defined within the base 16.

Figure 3:
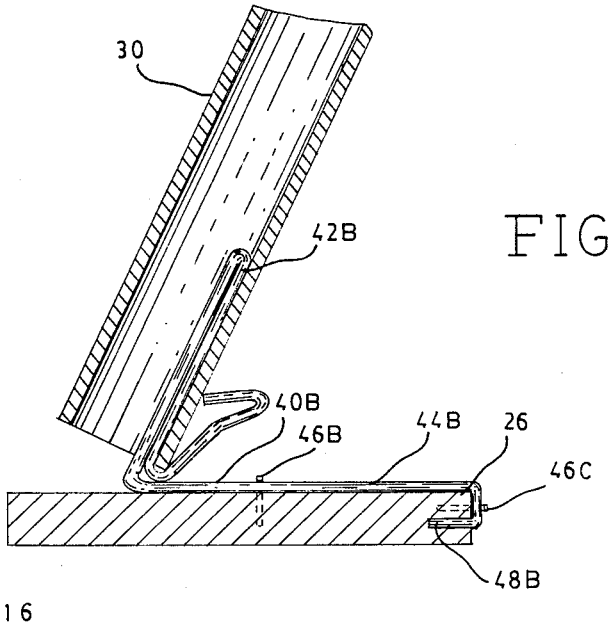

FIG. 3 illustrates an alternate embodiment in which end portion 42B of means 40B which secures the member 30 to the base 16 defines a clip section which secures the lower end portion 34 of the member 30. The opposite end portion 44B is secured to the base 16, by suitable staples 46B and 46C. The terminus end portion 48B is inserted into a suitable bore opening onto the upstanding edge or wall 26 of the base.

FIG. 4 illustrates at 40C an alternate embodiment of the means 40 in which the end portion 42C is inserted into a suitable bore or opening defined in the lower portion 34 of the member 30.

FIG. 5 illustrates an embodiment in which end portion 42D of the means for mounting the member 30 onto the base 16 is secured to the member 30 by an adjustable collar 48 of conventional design.

Finally, FIG. 6 illustrates a further embodiment in which end portion 42D of the means 40 is secured to the member 30 by bending the terminus end portion through a suitable bore 50 defined in the wall of the member 30 as is shown.

Similarly, the optional arrangement and end portion 42E can be secured, as is shown in the phantom line of FIG. 6, to the member 30 by extending the wire through the upper opening at end portion 32 defined by the member 30 and bending the terminus end portion about the upper edge of the tube at the location indicated at 52. It will be noted in the embodiment depicted in FIG. 6 that the end portion 44D of the wire is secured to the upper surface 18 of the base 16 by the illustrated staples.

From the discussion above, it will be appreciated that a launch pad has been provided for bottle rockets which allows the fireworks enthusiast to readily adjust the angle at which the rocket is launched. Moreover, the launch pad of the present invention is easy to manufacture and provides firm support for a rocket.

While a preferred embodiment has been shown and described, it will be understood that there is no intent to limit the invention to such disclosure, but rather it is intended to cover all modifications and alternate constructions falling within the spirit and scope of the invention as defined in the appended claims and equivalents thereof. For example, while a tubular member 30 has been shown for slidably receiving and aiming the rocket, it will be recognized by those skilled in the art that a helically bent wire could be used to define a member for slidably receiving and aiming the rocket.

I claim:

1. A fireworks rocket launch pad from which a fireworks rocket is fired, said launch pad comprising:

a tubular member having a cylindrical wall and defining a passageway therethrough for slidably receiving said rocket and from which said rocket emerges upon being launched, said tubular member having an upper end portion defining a first opening accessing said passageway and a lower end portion defining a second opening accessing said passageway;

a base for supporting said tubular member; and means for mounting said tubular member on said base, said means for mounting including a wire having a first end portion for being secured to said base and a helically-shaped second end portion for being received through said second opening of said tubular member and closely received by said passageway of said tubular member, whereby said helically-shaped second end portion of said wire engages the inner surface of said wall of said tubular member such that obstruction of said passageway is minimized.

2. A fireworks rocket launch pad from which a fireworks rocket is fired, said launch pad comprising:

a tubular member having a cylindrical wall and defining a passageway therethrough for slidably receiving and aiming said rocket and from which said rocket emerges upon being launched, said tubular member having an upper end portion defining a first opening and a lower end portion defining a second opening;

a base for supporting said tubular member, said base comprising upper and lower surfaces, said base being provided with a bore therein; and means for mounting said tubular member on said base, said means for mounting including a wire having a first end portion for being secured to said base and a helically-shaped second end portion for being received through said second opening of said tubular member and closely received by said passageway of said tubular member, whereby said helically-shaped second end portion of said wire engages the inner surface of said wall of said tubular member such that obstruction of said passageway is minimized, said wire also defining an intermediate portion extending between the point of engagement of said wire with said base and the point of engagement of said wire with said tubular member, said wire being fabricated of a bendable metal such that said wire can be selectively bent proximate said intermediate portion to adjust the angular disposition of said tubular member to facilitate the aiming of said rocket, said first end portion of said wire defining a base engaging portion provided with a plurality of bends disposed in a common plane to facilitate stable engagement of said wire with said upper surface of said base, said first end portion further defining a terminus end portion for being received in said bore of said base.

3. The rocket launch pad of claim 2 wherein said bore of said base is disposed in said upper surface of said base, and wherein said terminus end portion of said wire is substantially perpendicular to said plane defined by said base engaging portion.

4. The rocket launch pad of claim 2 wherein said base defines an upstanding edge connecting at least a portion of the perimeters of said upper and lower surfaces of said base, and wherein said bore is provided in said edge of said base.

5. The rocket launch pad of claim 2 wherein said base engaging portion of said wire defines a Z-shaped configuration, and wherein said first end portion of said wire is secured to said base with staples.

* * * * *